US005366354A

United States Patent [19]

Yuge

[11] Patent Number: 5,366,354

[45] Date of Patent: Nov. 22, 1994

[54] VARIABLE FLUID VOLUME VANE PUMP ARRANGEMENT

[75] Inventor: Kazuyoshi Yuge, Fuji, Japan

[73] Assignee: Jatco Corporation, Fjui, Japan

[21] Appl. No.: 26,034

[22] Filed: Mar. 4, 1993

[30] Foreign Application Priority Data

Mar. 6, 1992 [JP] Japan ..... 4-49401

[51] Int. Cl.[5] ..... F04C 2/344; F04C 15/04

[52] U.S. Cl. ..... 418/26; 418/27; 418/30

[58] Field of Search ..... 418/24–27, 418/30; 417/220

[56] References Cited

U.S. PATENT DOCUMENTS

| | | | |
|---|---|---|---|
| 2,433,484 | 12/1947 | Roth | 418/30 |
| 2,811,926 | 11/1957 | Robinson, Jr. | 418/30 |
| 4,558,998 | 12/1985 | Kiyoshige et al. | 418/26 |
| 5,090,881 | 2/1992 | Suzuki et al. | 418/26 |

FOREIGN PATENT DOCUMENTS

| | | | |
|---|---|---|---|
| 0095194 | 11/1983 | European Pat. Off. . | |
| 4041248 | 7/1991 | Germany . | |
| 62-276286 | 12/1987 | Japan . | |
| 3-3987 | 1/1991 | Japan | 418/30 |
| 3279686 | 12/1991 | Japan | 418/30 |

*Primary Examiner*—John J. Vrablik
*Attorney, Agent, or Firm*—Foley & Lardner

[57] ABSTRACT

A noise and cavitation suppressing variable fluid volume vane type rotary pump has fluid inlet and outlet ports in communication with the interior portion of a pump housing. A cam ring is arranged in an inner chamber of the pump housing, for enabling adjustment of fluid flow volume in the pump, and the cam ring is pivotable for allowing eccentric displacement thereof. A rotor having a plurality of vanes arranged in the radial direction thereof so as to make touching contact with an inner circumferential surface of the cam ring is rotatably arranged in the space defined within the inner circumference of the cam ring. First and second containments are defined at uppermost and lowermost points between the cam ring and the rotor. The cross sectional areas of the containments vary according to eccentric displacement of the cam ring. Concave recesses are also formed in the inner circumferential surface of the cam ring in the vicinity of the inlet and outlet ports, along with communication grooves having respective cross sectional areas and formed at locations corresponding to those of the containments. A regulating piston is operatively associated with the cam ring such that fluid variation in a fluid chamber regulates the piston such that the piston applies pressure for eccentrically displacing the cam ring. Displacement of the cam ring varies the cross sectional areas of the containments and controls an output volume of fluid through the outlet port of the pump.

6 Claims, 1 Drawing Sheet

VARIABLE FLUID VOLUME VANE PUMP ARRANGEMENT

BACKGROUND OF THE INVENTION

1. Field of The Invention

The present invention relates generally to a vane type fluid pump. Specifically, the present invention relates to a variable fluid volume vane type pump which may be utilized in automotive engines.

2. Description of The Prior Art

Vane type rotary pumps capable of variable fluid volume operation are well known in the automotive field. For example, Japanese Patent Application First Publication (unexamined) 62-276286 discloses one such conventional variable fluid volume vane pump for automotive applications.

According to the above arrangement, a housing, a cam ring and a rotor provided with a plurality of radially arranged vanes is provided. An inner circumferential surface of the cam ring is circular and is contacted by the vanes according to rotation of the rotor. The housing is provided with fluid inlet and outlet containments and fluid is moved from the fluid inlet to the fluid outlet according to movement of the vanes.

Also, according to the above-mentioned disclosure, semicircular grooves are provided respectively oil both sides of the cam ring for communicating between the inlet and outlet containments provided at the inner circumference of the cam ring. According to this construction, a width of the grooves is kept smaller than a thickness of the vanes attached to the rotor.

As mentioned above, communication between the inlet and outlet spaces is dependent on the grooves, thus the grooves mitigate pressure variation based on eccentric load etc. applied to the pump so as to prevent cavitation and reduce pump noise.

According to normal operation at a constant pump speed, the above measures are sufficient for suppressing cavitation and reducing pump noise. However, when an operating speed of the pump is subject to variation or fluctuation, such that pressures at the inlet and outlet containments are increased while pump timing is varied, is is extremely difficult to cancel out such pressure variation to prevent cavitation and pump noise.

SUMMARY OF THE INVENTION

It is therefore a principal object of the present invention to overcome the drawbacks of the prior art.

It is a further object of the present invention to provide a vane type fluid pump in which cavitation and pump noise may be suitably prevented even under conditions in which pressure and timing fluctuation occur during pump operation.

In order to accomplish the aforementioned and other objects, a variable fluid volume vane type rotary pump is provided, comprising: a pump housing, and fluid inlet and outlet ports in communication with an interior portion of the housing. Further provided is a cam ring arranged in an inner chamber of the pump housing enabling adjustment of fluid flow volume in the pump. A rotor is rotatably arranged in a space defined within the inner circumference of the cam ring, having a plurality of vanes arranged in the radial direction thereof so as to make touching contact with an inner circumferential surface of the cam ring according to rotation of the rotor. The cam ring is provided with a pivot for allowing eccentric displacement thereof, and a first containment is defined at an uppermost circumferential edge of the rotor between the rotor and the cam ring, a cross sectional area of the first containment varying according to eccentric displacement of the cam ring, a second containment is defined at a lowermost circumferential edge of the rotor between the rotor and the cam ring, a cross sectional area of the second containment also varying according to eccentric displacement of the cam ring. A first concave recess is formed in an inner circumferential surface of the cam ring in the vicinity of the inlet port and a second concave recess is formed in the inner circumferential surface of the cam ring in the vicinity of the outlet port, a first communication groove having a first cross sectional area is formed at a location corresponding to that of the first containment and a second communication groove having a second cross sectional area is formed at a location corresponding to that of the second containment. A regulating piston is operatively associated with the eccentric cam ring and is disposed at an outer circumferential portion of the cam ring. The regulating piston is associated with a fluid chamber such that fluid variation in the fluid chamber regulates motion of the piston such that the piston applies pressure for eccentrically displacing the cam ring on the pivot thereof, displacement of the cam ring varying the cross sectional areas of the first and second containments and controlling an output volume of fluid through the outlet port.

DESCRIPTION OF THE PREFERRED EMBODIMENT

Figure 1:
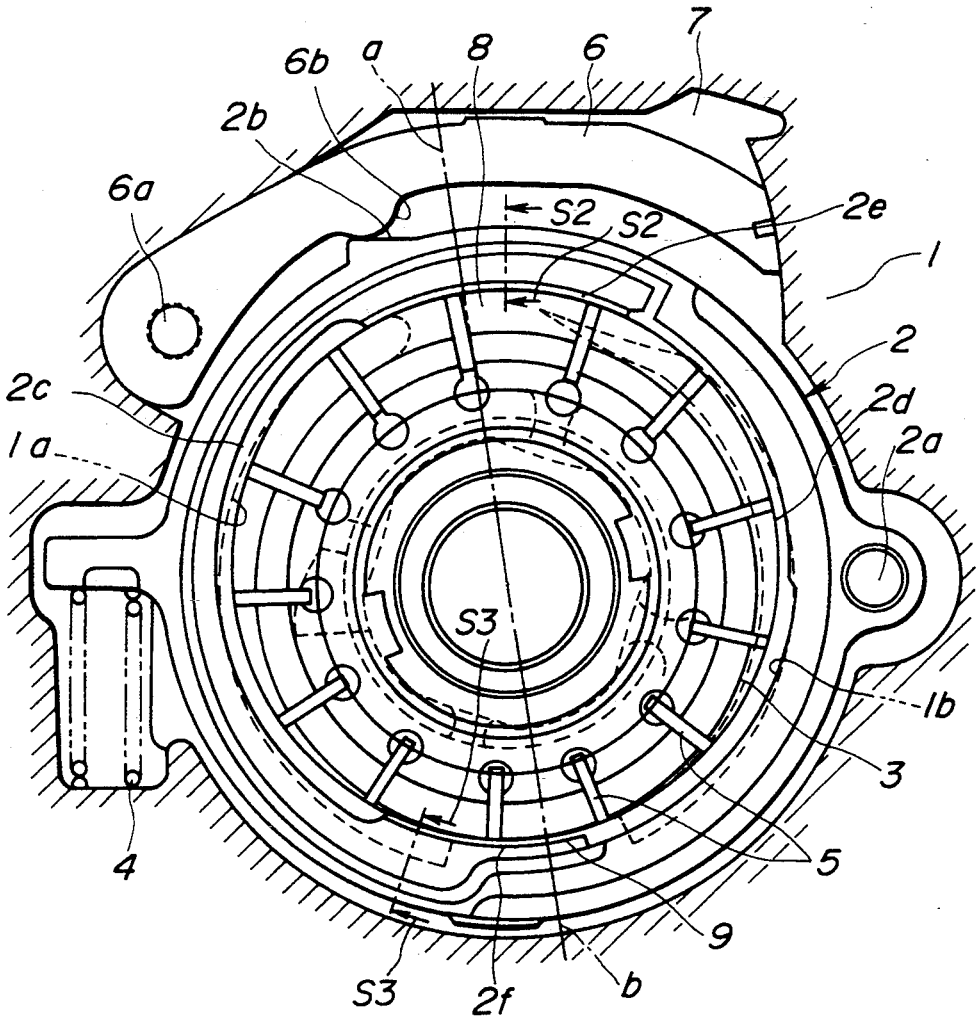
FIG. 1 is a plan view of the preferred embodiment of a variable fluid volume vane pump according to the invention.

Referring now to the drawings, particularly to FIG. 1, a plan view of a first embodiment of a variable fluid volume vane pump according to the invention is shown. The pump comprises a housing 1 having mounted therein a cam ring 2 having a pivotal axis **2*a* allowing eccentric swingable movement of the cam ring 2. Further, a rotor 3 is rotatably disposed at an inner circumference of the cam ring 2, an eccentric displacement of the rotor 3 being regulated according to swinging movement of the cam ring 2 on the pivotal axis 2*a*. A spring 4 applies additional force in the direction of eccentric movement of the cam ring 2**.

The rotor 3 has a plurality of vanes 5 radially disposed thereon and movable in a radial direction. Ends of the vanes 5 slidingly contact an inner circumferential surface of the cam ring 2 according to rotation of the rotor 3. It will be noted that the rotor 3 is mounted coaxially with a torque converter (not shown in the drawings) for co-rotation therewith.

As seen in FIG. 1, a lever-type piston 6 is swingably mounted on a pivot **6*a* in the pump housing 1 for adjusting eccentricity of the cam ring 2. The inner surface of the piston 6 has a convex portion 6*b* formed thereon so as to protrude from the inner surface of the piston 6**.

Opposing the convex portion 6b of the piston 6, the outer circumferential surface of the cam ring 2 is provided with a leveled portion 2b positioned so as to contact the convex portion 6b of the piston 6. Further, a fluid chamber 7 is formed at an outer side of the piston 6.

Thus, according to the above-described arrangement, the housing 1 encloses a rotatably mounted rotor 3, an outer circumference of which is proximate an inner circumference of a cam ring 2. At an uppermost position a of rotor travel an upper containment 8 is defined at the outer circumference of the rotor 3 and the inner circumference of the cam ring 2. Correspondingly, at a lowermost position b of rotor travel a lower containment 9 is defined at the outer circumference of the rotor 3 and the inner circumference of the cam ring 2. Also, proximate the position of the inlet portion 1a, a first concave recess 2c is formed in the inner circumferential surface of the cam ring 2 and in the vicinity of the outlet portion 1b a second concave recess 2d is formed in the inner circumferential surface of the cam ring 2.

Further, in the area of the upper containment 8 an upper communicating groove 2e is provided for providing fluid communication between the first concave recess 2c of the inlet portion 1a and the second concave recess 2d of the outlet port 1b. While, in the area of the lower containment 9, a lower communicating groove 2f is provided for providing fluid communication between the first concave recess 2c of the inlet portion 1a and the second concave recess 2d of the outlet port 1b.

Figure 2:
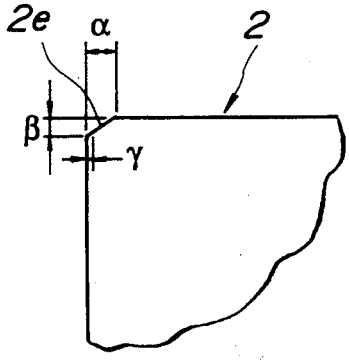
FIG. 2 is an enlarged cross-sectional view of a portion of the vane pump of the preferred embodiment, taken along line S2—S2 of FIG. 1.
Figure 3:
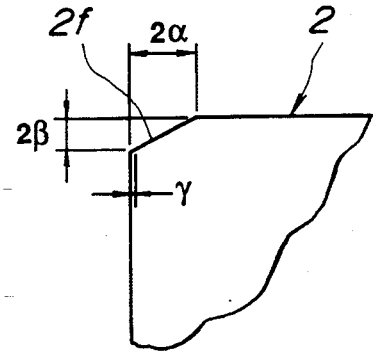
FIG. 3 is an enlarged cross-sectional view of a portion of the vane pump of the preferred embodiment, taken along line S3—S3 of FIG. 1

FIG. 2 shows a side view of the first communicating groove 2e. As may be seen in the drawing, the groove is formed as an angled first cut-out bevel of a predetermined dimension in a portion of the inner circumferential surface of the cam ring 2. While, as seen in FIG. 3, the second communicating groove 2f is formed as an angled second cut-out bevel of a second predetermined dimension in a portion of the inner circumferential surface of the cam ring 2. According to the present embodiment, a passage area of the second communicating groove 2f is four times the passage area of the first communicating groove 2e. At a time when the cam ring 2 swings to a position where the cross sectional area of the upper containment 8 becomes maximum, each of the communicating grooves have cross sectional areas between 0.1–2.0% of the area of the upper containment 8.

Hereinbelow, operation of the above described embodiment will be described in detail.

As the rotor 3 along with the vanes 5 are driven to rotate in the cam ring 2 the vane pump operates in a well known manner in which fluid introduced from the inlet port 1a is moved to the outlet port 1b to be expelled from the pump housing 1. At this time, fluid pressure in the fluid chamber 7 causes displacement of the lever-type piston 6 which applies pressure for eccentrically displacing the cam ring 2. This displacement of the cam ring 2 controls an output volume of fluid through the outlet port 1b.

According to the above-described construction, during operation of the vane pump, a pressure gradient is present at each of the communicating grooves 2e, 2f of each of the containments 8 and 9 respectively, from the input port 1a to the output port 1b. This pressure gradient causes bubbles within the fluid to collapse and thus, cavitation noise and the like is significantly reduced.

In addition, as the rotational speed of the rotor 3 increases, the pressure in the lower containment 9 also tends to increase while, on the other hand, pressure in the upper containment 8 tends to decrease. The concave recesses 2c, 2d respectively proximate the inlet port 1a and the outlet port 1b tend to absorb fluid pressure variation at the communicating grooves 2e and 2f allowing smooth pressure characteristics to be maintained, thus eliminating another cause of pump noise.

Also, the cross sectional areas of the communicating grooves 2e and 2f are determined such that the cross sectional area of the upper groove is set to be 0.1% or greater than a maximum possible cross sectional area provided for the upper containment 8 while the cross sectional area of the lower groove 2f is set to be 2.0% or less than a maximum possible cross sectional area provided for the upper containment 8. The above cross sectional areas were derived by experiment such that the most desirable flow and noise suppression characteristics are achieved.

Thus, in a variable fluid volume vane pump according to the invention, bubbles in a fluid which cause cavitation noise may be collapsed and significant fluctuation in pump output pressure may be prevented thus suppressing pump noise.

Also, unlike the prior art, the angles of the edges of the inlet and outlet ports need not be so strictly established, thus design and production freedom is increased.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A variable fluid volume vane type rotary pump comprising:

a pump housing;

fluid inlet and outlet ports in communication with an interior portion of said housing;

a cam ring arranged in an inner chamber of said pump housing, for enabling adjustment of fluid flow volume in said pump, said cam ring being provided with a pivot for allowing eccentric displacement of said cam ring;

a rotor rotatably arranged in a space defined within an inner circumference of said cam ring;

a plurality of vanes arranged in a radial direction of said rotor and slidingly movable in said radial direction so as to make touching contact with an inner circumferential surface of said cam ring according to rotation of said rotor;

a first containment defined between an outer circumference of said rotor and said inner circumferential surface of said cam ring, at a circumferential edge of said rotor, a cross sectional area of said first containment varying according to eccentric displacement of said cam ring;

a second containment defined between said outer circumference of said rotor and said inner circumferential surface of said cam ring, at a circumferential edge of said rotor opposite said first containment, a cross sectional area of said second containment varying according to eccentric displacement of said cam ring;

a first concave recess formed in said inner circumferential surface of said cam ring in the vicinity of said inlet port;

a second concave recess formed in said inner circumferential surface of said cam ring in the vicinity of said outlet port;

a first communication groove having a first cross sectional area and formed in the circumferential direction of said cam ring at a location corresponding to that of said first containment and providing fluid communication between said first concave recess and said second concave recess;

a second communication groove having a second cross sectional area and formed in the circumferential direction of said cam ring at a location corresponding to that of said second containment and providing fluid communication between said first concave recess and said second concave recess;

a regulating piston operatively associated with said cam ring and disposed at an outer circumferential portion of said cam ring; and a fluid chamber associated with said regulating piston such that fluid variation in said fluid chamber regulates motion of said piston such that said piston applies pressure for eccentrically displacing said cam ring on said pivot thereof, displacement of said cam ring varying said cross sectional areas of said first and second containments and controlling an output volume of fluid through said outlet port.

2. A variable fluid volume vane type rotary pump as set forth in claim 1, wherein the cross sectional area of said second communication groove is four times greater than the cross sectional area of said first communication groove.

3. A variable fluid volume vane type rotary pump as set forth in claim 1, wherein the cross sectional areas of said communication grooves are each between 0.1–2.0% of a maximum possible cross-sectional area of said first containment.

4. A variable fluid volume vane type rotary pump as set forth in claim 1, wherein the cross sectional area of said first communication groove is greater than or equal to 0.1% of a maximum possible cross-sectional area of said first containment and the cross sectional area of said second communication groove is less than or equal to 2.0% of the maximum possible cross-sectional area of said first containment.

5. A variable fluid volume vane type rotary pump as set forth in claim 1, wherein said regulating piston is a lever-type piston.

6. A variable fluid volume vane type rotary pump as set forth in claim 1, wherein said first and second communication grooves are defined as bevelled edges in said inner circumferential surface of said cam ring.

* * * * *